US012338026B2

(12) United States Patent
Biondi et al.

(10) Patent No.: US 12,338,026 B2
(45) Date of Patent: Jun. 24, 2025

(54) TRANSFER DEVICE AND PROCESS

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT)

(73) Assignee: G.D S.P.A., Bologna (IT)

( * ) Notice: Subject to any disclaimer, the term of this patent is extended or adjusted under 35 U.S.C. 154(b) by 37 days.

(21) Appl. No.: 18/006,491

(22) PCT Filed: Jul. 26, 2021

(86) PCT No.: PCT/IB2021/056719
§ 371 (c)(1),
(2) Date: Jan. 23, 2023

(87) PCT Pub. No.: WO2022/029547
PCT Pub. Date: Feb. 10, 2022

(65) Prior Publication Data

US 2023/0294857 A1 Sep. 21, 2023

(30) Foreign Application Priority Data

Aug. 5, 2020 (IT) ..... 102020000019318

(51) Int. Cl.
*B65B 7/28* (2006.01)
*B65B 7/01* (2006.01)
*B65B 29/02* (2006.01)

(52) U.S. Cl.
CPC ..... *B65B 7/2807* (2013.01); *B65B 7/01* (2013.01); *B65B 29/022* (2017.08)

(58) Field of Classification Search
CPC ... B65B 29/022; B65B 43/50; B32B 2250/03; B32B 2250/20; B32B 2262/0253;
(Continued)

(56) References Cited

U.S. PATENT DOCUMENTS

2016/0144987 A1 5/2016 Scrivani
2016/0229570 A1* 8/2016 Rea ..... B65B 1/12
(Continued)

FOREIGN PATENT DOCUMENTS

EP 3040285 A1 7/2016
IT 20180001115 3 A1 6/2020

OTHER PUBLICATIONS

International Search Report and Written Opinion for International Application No. PCT/IB2021/056719 filed on Jul. 26, 2021 on behalf of G.D S.P.A. Mail Date: Jan. 7, 2022 16 pages.

*Primary Examiner* — Robert F Long
*Assistant Examiner* — Xavier A Madison
(74) *Attorney, Agent, or Firm* — Steinfl + Bruno LLP

(57) ABSTRACT

In a device and in a process for transferring discrete elements, fed in a row with a predetermined spacing, a correspondence is ensured between a linear release segment, and a not entirely linear portion of transport path. A carousel-like transport device is provided, where receiving members move along the transport path. A receiving segment is defined, where each receiving member receives a respective discrete element. A release device is further provided, on which the discrete elements are transported along a linearly developing release path having a release segment and intersecting the transport path at the receiving segment. A timing equipment acting on the receiving members by moving them with respect to the transport device is also provided.

20 Claims, 4 Drawing Sheets

(58) Field of Classification Search
CPC ..... B32B 2262/0276; B32B 2307/718; B32B 2307/732
USPC ..... 53/410
See application file for complete search history.

(56) References Cited

U.S. PATENT DOCUMENTS

| | | | | |
|---|---|---|---|---|
| 2017/0121044 | A1* | 5/2017 | Castellari | B65B 7/01 |
| 2022/0048653 | A1 | 2/2022 | Biondi et al. | |

* cited by examiner

TRANSFER DEVICE AND PROCESS

CROSS REFERENCE TO RELATED APPLICATIONS

The present application is the US National Stage of International Patent Application No. PCT/IB2021/056719, filed on Jul. 26, 2021, which in turn, claims priority to Italian Application No. IT 102020000019318, filed on Aug. 5, 2020.

The present invention relates to a transfer device and process for discrete elements in a packaging apparatus and process.

The present invention finds a preferred, though not exclusive, application in the field of canned packaging of loose articles, such as capsules for infusion products, for example coffee, a field to which reference may be made hereafter without loss of generality.

In particular, in the relevant technical field, transfer devices are known to couple discrete elements of various kinds together and to apply a shaping process to these discrete elements by means of appropriate devices. This coupling is influenced by the format of the discrete elements which, if it were to change, would result in a different way of delivering the discrete elements in terms of spacing, release position and/or release rate, parameters to which the transfer device and its process must adapt.

Therefore, the need to individually handle a quantity of discrete elements and to couple them together implies the need to transfer these discrete elements, in the packaging apparatus, from one station to another, i.e., by way of example, from a station where they are obtained by a cutting operation and with a predetermined format, to a subsequent station where the discrete elements will undergo a shaping and coupling process.

In this description as well as in the accompanying claims, certain terms and expressions are deemed to have, unless otherwise expressly indicated, the meaning expressed in the following definitions.

Here and in the following, a discrete element is defined as an element formed from a single piece that must be processed individually at high speed, with the final aim of coupling it to a corresponding discrete target element.

In particular, it is envisaged that these discrete elements, downstream of a possible processing or extraction process or even preforming, are fed into rows of discrete elements, in which there is a predetermined spacing between the discrete elements, which allows the intervention of tools without them interfering with discrete elements that are not within their competence.

By way of example, a discrete element may consist of a component that is intended to be coupled with a capsule for infusion type products, which generally has a glass shape and is supplied to the packaging process already formed.

This discrete element may constitute the semi-finished product to obtain a filter or a lid for the capsule, and which will then have to be coupled to it by special coupling and shaping operations.

In the case of the filter, the discrete element may be a laminar element, e.g. disc-shaped, made of a substantially paper-like material to make infusion filters, which thus allow the filtered passage of a water-based infused liquid, without allowing an infusion material such as ground coffee or shredded tea leaves to pass through.

By way of example, these discrete elements can be fed one by one, or cut directly from a strip of suitable material using a cutting device.

In any case, in a release step the discrete elements have, in addition to a spacing between them, a release spot and a release speed, understood as a vector that also determines a release direction.

Once fed, these discrete elements must each be placed on a respective receiving element.

In view of the subsequent operations to which the discrete element is subjected, e.g. transport, shaping and application to the target capsule, the positioning of the discrete element on the respective receiving element must be extremely precise, otherwise subsequent processing may be performed incorrectly.

It is understood that discrete elements, as well as receiving elements, are continuously transported when they move with a predetermined speed, possibly variable, i.e. subject to acceleration and deceleration, but never zero. Continuous feeding and transport are therefore different from step feeding and transport, in which the corresponding discrete elements and/or receiving elements move in jerks.

Feeding or transport "in a row" means that discrete elements are supplied in a succession of discrete elements aligned with each other, resulting from an extraction or processing.

It is understood that in the row, each discrete element is spaced from the elements preceding and following it with a constant spacing, resulting from the extraction and/or processing step.

A "release device" means a device that provides said discrete elements in the manner mentioned above.

"Release segment" means a segment along which said release device transfers discrete elements to a subsequent transport path. In particular, when discrete elements whose format is different are fed, their release takes place at a release spot that may vary according to the format of the discrete element, but the release spot of discrete elements of different format will always belong to the same release segment, which can therefore be defined as the linear segment on which the possible release spots of a release device fall.

"Receiving segment" means a segment of the transport path where the transfer of discrete elements released by the release device takes place. Therefore, the receiving segment and the release segment must correspond to each other in order for such a transfer to take place.

"Linear development", or more briefly "linear", i.e. a linear path or path, means a path or path that runs along a clearly identifiable line, which may be straight, broken or curved, and possibly closed.

"Transport device" means any system designed to transport discrete elements while maintaining their respective singularity, i.e. without them interfering with each other in any way.

This type of transport is necessary so that discrete elements can be correctly selected, formed and then applied to a target element.

"Transport path" refers to the path travelled by the receiving elements intended to individually receive a respective discrete element.

"Closed transport path" means a transport path of the receiving elements which develops along a closed line, in particular in a substantially horizontal plane.

A transport device "of the carousel type" means a transport device in which a plurality of moving members, such as, for example, said receiving elements, are transported along a closed transport path, causing the receiving elements or, in any case, the moving members present on it to make a repetitive revolutionary motion, which for this reason differs from a return motion typical of a belt conveyor.

"Timing equipment" means an equipment acting on the moving members of a carrousel-like transport device, which is capable of adapting, for short portions of the transport path, the law of motion followed by the moving member to particular conditions such as position along a linear segment and constant travel speed, by locally modifying the transport path and the transit speed of the moving members.

"Cam" means a physical or virtual member that is provided to drive the timing equipment. The concept of a cam can be interpreted in the mechanical sphere as an element that determines a cam profile on which a plurality of articulated cam transferors with respective moving members slide. However, the same concept can be realised by a set of electric and electronic motors and devices, which are driven according to a virtual cam profile of a so-called electronic cam.

The "change of format" of discrete elements means the eventuality of carrying out, in a format device, the feeding of discrete elements whose characteristics, in particular dimensions, reciprocal spacing, release spot in the release segment and release speed, are different.

The Applicant has noted that, in packaging processes, the speed of transfer and insertion of the articles to be packaged into the target packagings is crucial to the overall economics of the process, as high production volumes can be achieved with fewer packaging apparatuses.

Furthermore, the Applicant has observed that, in addition to the need to proceed as quickly as possible, another important and unavoidable requirement is the flexibility required of this type of equipment, in particular with regard to the different production formats, which entail the need to be able to operate, with the same apparatus, on different shapes and sizes of discrete elements.

This need is particularly acute at high speeds, when precise and correct positioning of discrete elements in their target positions is critical to the economy of the production process.

Moreover, this requirement is reinforced when, in the case of capsules of different format, the discrete elements must adapt to the dimensions of the final filter, and are therefore supplied with different diameters.

The Applicant has also verified that maintaining a minimum distance between the discrete elements being fed is an optimal processing condition, as it leads to a reduction in the passage time.

In addition, in the specific case of filters, they can be cut to the correct size from a continuous strip of suitable material, and maintaining a minimum distance allows less material to be discarded.

The Applicant has found that, in general, maintaining this minimum spacing, together with the use of the highest possible transport speeds, results in different release speeds and even small but significant differences in the exact point at which the individual discrete element is released from the target transport device.

Although this requirement arises in both continuous and step feeding, especially in continuous feeding and at high speeds this problem requires adjustments in the transport path of the receiving elements.

The Applicant has also noted that, in order to meet particular production requirements, a change of format could nevertheless result in different release spots and/or speeds, irrespective of the maintenance of the aforesaid minimum spacing at the cutting step.

Furthermore, the need to control and possibly vary the position and/or speed of release of the discrete element may not be linked to a cutting operation, but to a different feeding technique, perhaps referring to discrete elements other than those used to obtain a filter for a capsule.

The Applicant also realised that the transport path of the receiving elements, at a receiving segment, could be synchronised according to the flow of the incoming discrete elements, allowing the necessary positioning accuracy to be determined.

The Applicant has therefore perceived that the transport path could be timed in the position of the receiving elements in a transport device with a correction of a mechanical or electronic nature, acting on the individual receiving elements, provided that they can move limitedly with respect to the transport device itself.

Finally, the Applicant has found that, with the movable receiving elements, it is possible to apply a timing equipment to the transport device which is capable of meeting the requirements outlined above, without adversely affecting the operating speed, but allowing all the flexibility required.

In particular, in a first aspect thereof, the invention relates to a transfer device for discrete elements.

Preferably, the discrete elements are fed, at the inlet of the transfer device, in a row with a predetermined spacing.

Preferably, the transfer device comprises a carousel-like transport device in which a plurality of receiving elements move along a closed line transport path.

Preferably, a receiving segment is defined in such a transport path in which the receiving elements each receive a respective discrete element.

Preferably, the transfer device according to the present invention comprises a release device on which said discrete elements are transported along a release path with a linear development.

Preferably, the release path has a release segment.

Preferably, the release path intersects said transport path at said receiving segment.

Preferably, the transport device comprises a timing equipment acting on said receiving elements.

In particular, this timing equipment is provided to move the receiving elements by moving them relative to the transport device.

Preferably, the timing equipment varies the position of the receiving elements in said receiving segment, thereby the movement thereof, in said receiving segment, is synchronized with the movement of the discrete elements in the release segment.

Thanks to these characteristics, it is possible to create a transfer device in which an exact correspondence is ensured between a release segment of the discrete element, which is linear, and a portion of a transport path which, being on a closed line, cannot be entirely linear.

This correspondence ensures the necessary positioning accuracy of the discrete elements in the transport device.

In addition, again thanks to these features, the packaging apparatus does not require any timing of the transport device in the event of a system calibration or format change.

In a second aspect thereof, the invention concerns a transfer process for discrete elements.

Preferably, discrete elements are fed in a row with a predetermined spacing.

Preferably, the transfer process comprises a step of circulating a plurality of receiving elements along a closed line transport path.

Preferably, a receiving segment is defined in such a transport path in which the receiving elements each receive a respective discrete element.

Preferably, the transfer process comprises a step of transporting said discrete elements along a release path with a linear development.

Preferably, the release path has a release segment and intersects said transport path at said receiving segment.

Preferably, the transfer process comprises a step of moving said receiving elements, thereby the position thereof in said receiving segment corresponds to that of the discrete element position in the release segment in at least one portion of the receiving segment.

In other words, the possibility of aligning and moving the receiving elements relative to each other in the release segment makes the correspondence between the exact release spot of the discrete element, in the release segment, and the respective receiving element more precise.

Furthermore, since the receiving elements are synchronised without interrupting the transport process, the latter must not be slowed down.

In a third aspect thereof, the present invention relates to a packaging apparatus comprising a transfer device for discrete elements according to the first aspect of the invention as outlined above.

In other words, this apparatus comprises a transfer device which allows the passage of discrete elements from a release device to a transport device with great precision, determined by the timing between the release segment of the discrete elements and the receiving segment of the receiving elements.

In a fourth aspect thereof, the present invention concerns a process for providing a change of format in a transfer device for discrete elements according to different formats thereof.

Preferably, discrete elements are fed to the inlet in a row with a predetermined spacing.

Preferably, the above-mentioned transfer device comprises a carousel-like transport device.

Preferably, in the carousel-like transport device, a plurality of receiving elements move along a closed line transport path, and each of them is apt to receive a respective discrete element.

Preferably, the transfer device comprises a release device on which said discrete elements are transported in said row along a release path with a linear development.

Preferably, the release path with a linear development intersects said transport path and has a release segment that includes the release spots of discrete elements of different format.

Preferably, the transfer device includes an equipment for timing the transport device, which acts to vary the transport path and the transit speed of the receiving elements at said release path.

Preferably, the process for providing a change of format comprises a step of selecting discrete elements for one or more formats determining respective a release spot, a spacing and/or a release speed.

Preferably, the process for providing a change of format comprises a step of providing one or more portions of the transport path in a closed line and by means of said timing equipment.

Preferably, the aforesaid one or more portions of the transport path are positioned at said release segment.

Preferably, the position of said portions of the transport path and the respective translation speeds of the receiving elements are in accordance with the release spot and the release speed of the selected discrete elements.

Thanks to these features, a change of format of the discrete elements is possible in the transfer device, and not only is this possible without altering the operation of the device, but this does not involve any technical intervention on the parts of the device that are not directly involved in the change of format.

In other words, the receiving elements will, in the course of their revolutionary motion, cross portions of their transport path whose position, and the linear translation speed therein, are already set for one or more discrete element formats that the machine can handle.

In a fifth aspect thereof, the present invention relates to a process for providing a format change in a transfer device for discrete elements according to different formats thereof, fed with a predetermined spacing.

Preferably, the transfer device comprises a transport device in which a plurality of receiving elements, each capable of receiving a respective discrete element, move along a closed line transport path in which a linear receiving segment of the discrete elements is defined.

Preferably, the transfer device further comprises a release device on which said discrete elements are transported along a release path with a linear development superimposed on said linear receiving segment.

Preferably, the process for providing a format change comprises a step in which discrete elements of a first format are fed into the inlet of the transfer device in a row with a respective predetermined spacing.

Preferably, the process for providing a format change comprises a step in which discrete elements of at least one further format are fed into the inlet of the transfer device in a row with a respective predetermined spacing.

Preferably, in the process for arranging a change of format, a respective release spot of a discrete element is determined by said spacing on a respective portion of the receiving segment.

Thanks to these features, once the format change is set up in the transfer device, it can transfer discrete elements of different formats with great flexibility, accepting discrete elements of different formats fed with different or even the same spacing.

In a sixth aspect thereof, the present invention relates to a transfer device for discrete elements of different format.

Preferably discrete elements are fed to the inlet in a row with a predetermined spacing.

Preferably, the transfer device comprises a carousel-like transport device.

Preferably, in the carousel-like transport device, a plurality of receiving elements move along a closed line transport path, and each of them is apt to receive a respective discrete element.

Preferably, the transfer device comprises a release device on which said discrete elements are transported in said row along a release path with a linear development.

Preferably, the release path with a linear development intersects said transport path and has a release segment that comprises the release spots of discrete elements of different formats.

Preferably, the transfer device comprises a timing equipment of the transport device which acts to vary the transport path and the transit speed of the receiving elements at said release path.

In this way, one or more portions of the transport path are provided and positioned at said release spots.

Preferably, in said release portions, the receiving elements have respective translation speeds that correspond to the release speed of the discrete elements of different formats.

In other words, the transfer device includes in itself the provision to transfer discrete elements of different format, because the elements that receive on their surface the single discrete elements have, in their transport path, portions of this path that are already positioned to correctly receive discrete elements of different format, and they also cross these portions at a constant speed, which corresponds to the speed of release of the discrete element of the format corresponding to that portion.

Therefore, in order to obtain the correct transfer of the discrete elements in the various formats already provided, it is sufficient to prepare their supply: the remaining parts of the transfer device are already set up to carry out this transfer.

In a seventh aspect thereof, the present invention relates to a packaging apparatus comprising a transfer device for discrete elements of different formats, according to the fifth aspect of the invention as outlined above.

Therefore, such packaging apparatus can benefit from the flexibility of processing discrete elements of several different formats, without the need to alter or reprogram any of its parts.

In at least one of the aforesaid aspects, the present invention may further comprise at least one of the following preferred features.

Preferably, the transfer device according to the present invention has a receiving segment comprising one or more portions which are travelled by the receiving elements at a respective substantially constant translation speed.

This allows the transfer device to transfer, without intervention, discrete elements whose format was known during construction.

Preferably, the receiving segment comprises two or more portions which are travelled by the receiving elements at different, substantially constant translation speeds, so that the transfer device can transfer without modification more than one discrete element format.

Preferably, the carousel-like transport device comprises a rotary drum on the periphery of which said receiving elements are mounted, and thus the transport path is substantially circular.

This makes the transfer device particularly compact. It can therefore be seen that, in order to increase the transfer speed, it is sufficient to increase the rotation speed of the carousel-like transport device.

In addition, said discrete elements are fed continuously, allowing high transfer speeds to be achieved.

Preferably, at said receiving segment, the receiving elements are aligned with each other, increasing the accuracy with which the position of the discrete elements is obtained on the receiving elements.

Preferably, said receiving elements move continuously along the transport path, still allowing high transfer speeds to be achieved.

In this respect, it should be noted that the feeding of discrete elements and the rotation of the carousel-like transport device allow flows of discrete elements with rates of more than 600 pieces per minute, preferably more than 1000 pieces per minute.

Preferably, the timing equipment comprises, for each receiving element, a rotatable articulation driven by the transport device.

In addition, this rotatable articulation is connected to the receiving element in such a way that its motion is synchronised with that of the discrete elements in the release segment.

This makes it possible to precisely determine the position of the receiving elements in their transport path.

Preferably, the articulation comprises at least one movable lever around a fulcrum. In addition, there is provided an equipment for rotating the lever around its fulcrum.

Preferably, said rotatable articulation is driven by a cam which may be mechanical or electronic.

This allows the transfer device to be provided to transfer discrete elements of different formats, with cams corresponding to the selection of the chosen formats.

In the case of a mechanical cam, a change of cam will be sufficient to change the format or formats of the discrete elements to be transferred. In the case of the electronic cam, it can be conveniently reprogrammed for the same purpose.

Therefore, preferably, in order to provide a change of format in the transfer process, it comprises a step of determining the profile of the cam.

In particular, in the transfer device the cam profile varies the transport path and the transit speed of the receiving elements, thus adapting it to several discrete element formats, which will have respective release spots and release speeds.

Preferably, in the case of the mechanical cam, said rotation equipment comprises a cam transferor, connected to said at least one lever at its fulcrum, which moves on a cam which, in turn, determines the position timing of the receiving elements, with respect to the discrete elements, at the receiving segment.

In this way, this purely mechanical solution makes the whole system simpler and more error-proof.

Preferably, said linear release path is defined by a flat strip from which said discrete elements are cut with said predetermined spacing.

In this way, discrete elements can be produced on the spot from a material supplied in reels.

Preferably, said strip, at said release spot, is wound around a roller-like drum which rotates with a peripheral speed corresponding to a release speed of the discrete elements and which is equal to the translation speed of the receiving elements in the portions where the respective release spots fall.

In this way, a constant release speed is ensured, which depends on the characteristics of the rotary drum, in particular the diameter thereof, and the rotation speed that is set.

Preferably, in the event of a change of format, the translation speed of the receiving elements in the two aforesaid release portions is such as to ensure a constant frequency of passage of the discrete elements, which may be greater than 600 pieces per minute, preferably greater than 1000 pieces per minute.

In this way, the aforesaid passage frequency will remain unchanged in the event of a format change, and this will also apply to all stations of a packaging machine connected to this transfer device.

Preferably, in the process for providing a format change, if the spacing of the further format is equal to the spacing of the first format of the discrete elements, their release spot falls in the same receiving portion, for all formats.

On the other hand, if the spacing of said further format is different from the spacing of said first format, the release spot of the discrete elements of said first and said further format falls in different receiving portions.

It should be noted that in the case of discrete elements obtained from a strip by cutting from a roller-like drum with cutting elements, the format change of the discrete elements can be effectively achieved with two roller-like drums of the same diameter, or where the spacing between the discrete elements does not vary.

Otherwise, the format change can be achieved with roller-like drums of different diameters and spacing between discrete elements that varies accordingly.

In both cases, it is possible to prepare the transfer device for the format change, and thus to carry out the format change without having to intervene on the transfer device again.

Preferably, in the process that prepares a format change, the steps of feeding discrete elements to the inlet integrate a step in which the discrete elements are formed in the release device.

Preferably, the release device comprises a set with two or more roller-like drums, in particular of different diameters, for discrete elements of different format or with different spacing.

Thanks to this feature, the simple replacement of a roller-like drum with another that is provided for discrete elements whose format is already encoded in the transfer device allows the latter to process it without any further adaptation of the structure.

Preferably, each receiving element comprises a horizontal flat surface, on which said discrete elements are released, which facilitates the deposition of the discrete element.

Preferably, in order to retain the discrete element in a fixed reference position, the receiving element receiving the discrete element comprises a vacuum forming suction system between the receiving surface of the receiving element and the discrete element.

This allows the discrete element to be associated with the receiving element at a predefined position.

The present invention will hereinafter be described according to a preferred embodiment example thereof, which is provided for illustrative and non-limiting purposes with reference to the accompanying drawings in which.

Figure 1:
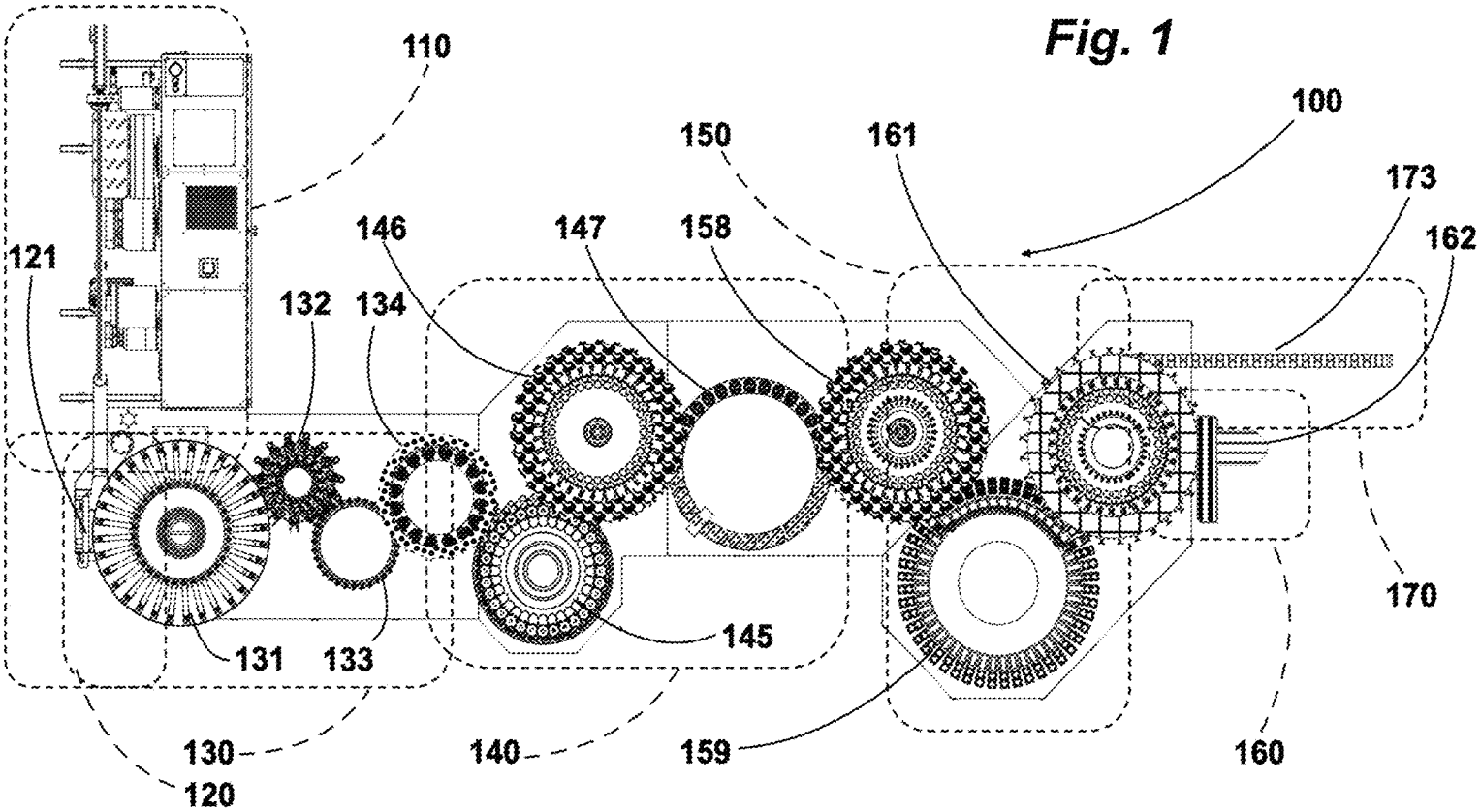
FIG. 1 shows a plan view of an embodiment example of a packaging apparatus comprising a transfer device for discrete elements made according to the present invention.
Figure 2:
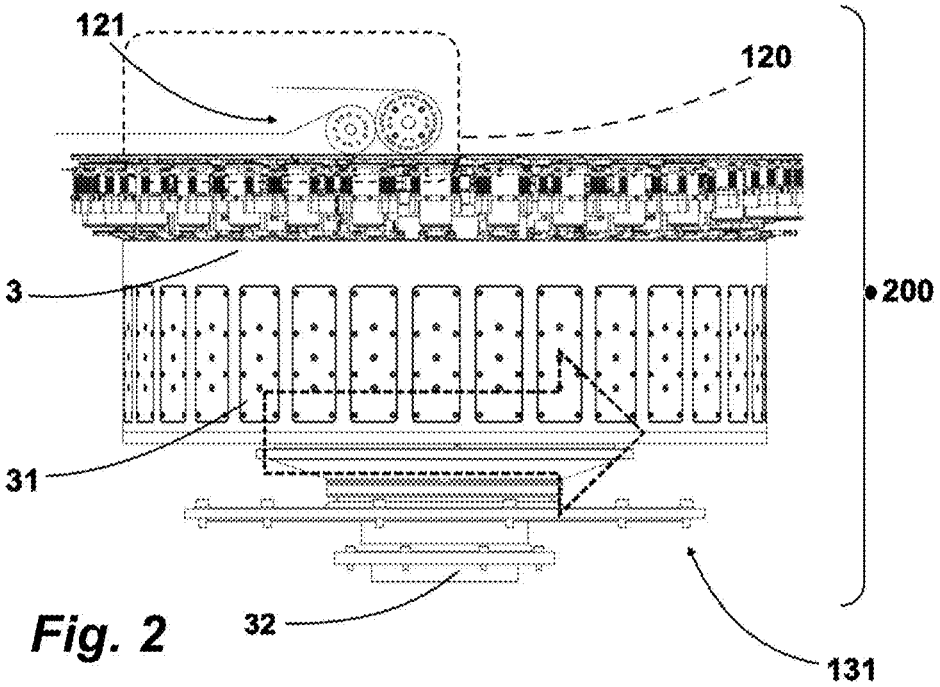
FIG. 2 shows a side elevation view of a transfer device made according to the present invention.
Figure 3:
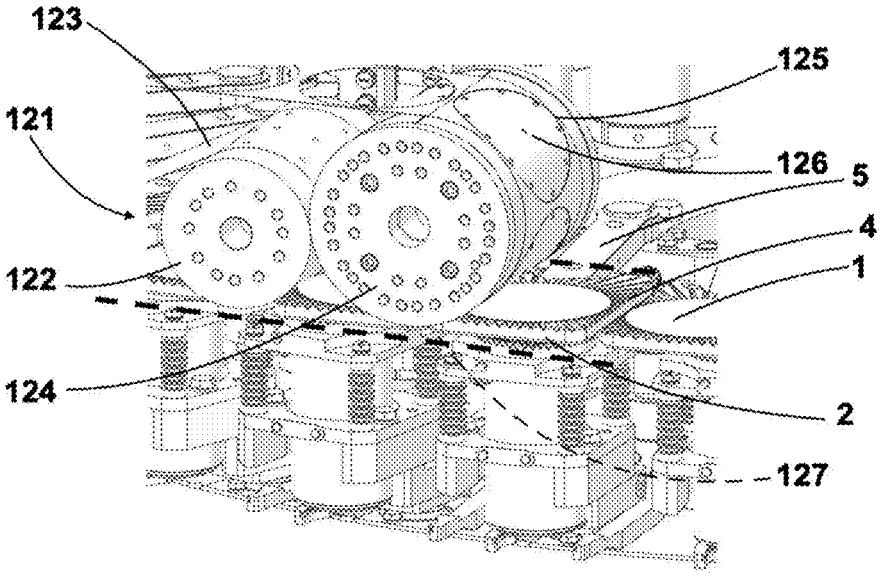
FIG. 3 shows a side perspective view of a second detail of the transfer device in FIG. 2.

With reference to the accompanying FIG. 1, 100 denotes an apparatus for packaging capsules for infusion type beverages, such as coffee.

These capsules consist of a substantially rigid glass-shaped container, inside which a filter and a coffee powder preparation is placed, and then they are sealed with a lid and sent to a subsequent apparatus where they are boxed for distribution and sale.

In general, the glass-shaped containers are supplied by a feeding station 110, from which they proceed in a row with a continuous motion after being extracted from a set of glass-shaped containers provided by a supplier.

The packaging apparatus 100 comprises a release station 120 of discrete elements, which will be indicated in the following figures by 1, which in the present example comprise flat discs of a material suitable for shaping a filter for infusion type beverages.

Thus, the release station 120 comprises a release device 121 which in the present example is a device for cutting said discs from a continuous strip of filter material.

The release device 120 thus provides discrete elements 1, in the form of discs, which are fed individually, i.e. one by one after a cutting step, in a single row with a predetermined spacing between one discrete element and a subsequent discrete element.

The packaging apparatus therefore comprises a filter shaping station, indicated by 130, which comprises a carousel-like transport device 131, which will be described in greater detail later.

The transport device 131 is part of a more complex station, in which said discrete elements 1, once transferred from the release device 121 to the transport device 131, undergo a filter shaping process, which is then inserted inside a destination glass-shaped container, which will possibly contain on its bottom a spacer element inserted inside it in the feed station 110.

After the filter has been inserted into the respective container, the filter is fixed, e.g. by welding, to the inside walls of the glass-shaped container.

In this respect, the transport device 131 transfers the glass-shaped containers with filters to a first transfer wheel 132, and from this they pass to a filter fixing wheel 133 to pass to a second transfer wheel 134 which transfers the glass-shaped containers to a filling station 140, where they are filled with a predetermined dose of coffee powder.

In this regard, the filling station comprises a carousel-like filling device 145 from which the glass-shaped containers are transferred, by means of a third transfer wheel 146, to a carousel-like weighing device 147, which performs a check on the amount of powder supplied to each container.

Upon leaving the weighing device 147, the containers are transferred by a fourth transfer wheel 158 to a sealing station 150. The apparatus 100 thus comprises a cutting station 160 for lids that are formed from a continuous strip by a cutting device 162.

The lids, which have a disc shape, are transferred, by means of a fifth transfer wheel 161, to a sealing device 159, also structured as a carousel, which receives the containers to be sealed from said fourth wheel 158 and which provides for the extraction of the gases from the glass-shaped container and for its sealing by applying on its upper opening a disc-shaped lid made from continuous strip.

Note how the cutting device 162 could constitute, in an alternative version of the apparatus, an additional release device.

Once sealed, the containers are sent to an outlet station 170, equipped with a linear transport device 173.

With reference to FIGS. 2 to 5, the transfer device described herein and indicated as a whole by 200, which embodies the present invention, comprises said release device 121 and said transport device 131, which in this example has a carousel structure.

The release device 121 comprises a first roller-like drum 122 which receives a continuous strip 123 from a feed reel, which is unrepresented and of a substantially conventional type.

A second roller-like drum 124 receives the strip 123 from the first roller-like drum 122: cutting elements 125 shaped as discs which act on the strip 123 are formed thereon.

In particular, the two roller-like drums 122, 124 are arranged side by side and rotate around parallel rotation axes; they roll, creating a contact zone through which the strip 123 is passed.

The first roller-like drum 122 acts as a contrast element for the cutting elements 125 which, in said contact zone, score the strip 123 and thus create the discrete elements 1.

They remain adhering to the second roller-like drum 124 which, for this purpose, incorporates a suction device with suction openings 126 arranged on the cylindrical surface thereof. The suction device will comprise suction ducts branching from the hub of the second roller-like drum 124 to the rotating body of the second roller-like drum 124, so as to ensure both adhesion of the strip 123, even after it has been cut, and of the discrete element 1 during cutting.

The suction ceases in the zone of the second roller-like drum 124 facing downwards:

along a release path with a linear development 127, which is part of a release path defined by a flat strip 123 from which the discrete elements 1 are cut.

Therefore, the second roller-like drum 124 acts as a cylindrical feeder which is rotated, at said release segment 127, about an axis parallel to a plane on which the discrete elements 1 are released, and which has on its surface a device for retaining and then releasing discrete laminar elements, which is realised by said suction device.

In the present embodiment example, considering that the roller-like drums rotate with a predetermined speed while carrying out the cutting operation described above, the discrete elements 1 are therefore continuously fed, and are then released at a release speed having a direction tangent to the point where the suction is made to cease, and an entity substantially corresponding to the peripheral speed of the second roller-like drum 124.

This transfer device is provided to change the format of the discrete elements, i.e. it can transfer different types of discrete elements, which may vary in size and/or shape, therefore substantially in diameter or equivalent diameter, and possibly in spacing.

One requirement that the present transfer device 200 intends to satisfy is the highest possible use of the strip 123, even when the format of the discrete elements 1 to be transferred varies.

For this reason, the spacing between adjacent circular discrete elements 1 of different format on the strip 123 will be as small as possible, and will vary according to the diameter of the discrete element 1 whose edges will be cut as close as possible to the edges of the discrete elements 1 adjacent thereto.

Note that spacing between discrete elements 1 herein means the distance between the centres of two adjacent discrete elements 1 on the flat strip 123.

Thus, a reduction in the diameter of the discrete elements 1 results in a reduction in the diameter of the respective second roller-like drum 124 and a reduction in the spacing of the discrete elements 1. Furthermore, if the speed of rotation of the second roller-like drum 124 around its axis does not change, or if it varies only slightly in order to leave the flow rate of the discrete element 1 unchanged, its peripheral speed decreases, and so does the release speed of the discrete element 1. Reducing the diameter thereof also results in a shift, in particular a retraction, of the release spot of the discrete element on release segment 127.

Similarly, all things being equal, an increase in the diameter of the discrete elements 1 results in a corresponding increase in the diameter of the respective second roller-like drum 124 and an increase in the spacing of the discrete elements 1. Furthermore, as before, if the rotation speed of the second roller-like drum 124 around its axis does not change or varies little, its peripheral speed increases, and so does the release speed of discrete element 1. The increase in its diameter also leads to a shift, in particular an advancement, of the release spot of the discrete element on the release segment 127.

In this way, the release segment 127 can be defined as the location of the spots where the release spots of discrete elements 1 of different formats fall.

The present transfer device 200 is provided for a format change of the discrete elements, and can be operated with a format change process so as to be able to ensure the transfer of discrete elements 1 of different format.

In this respect, the transfer device 200 comprises a set of roller-like drums 124 of different diameters, for discrete elements 1 of different format.

Figure 4A:
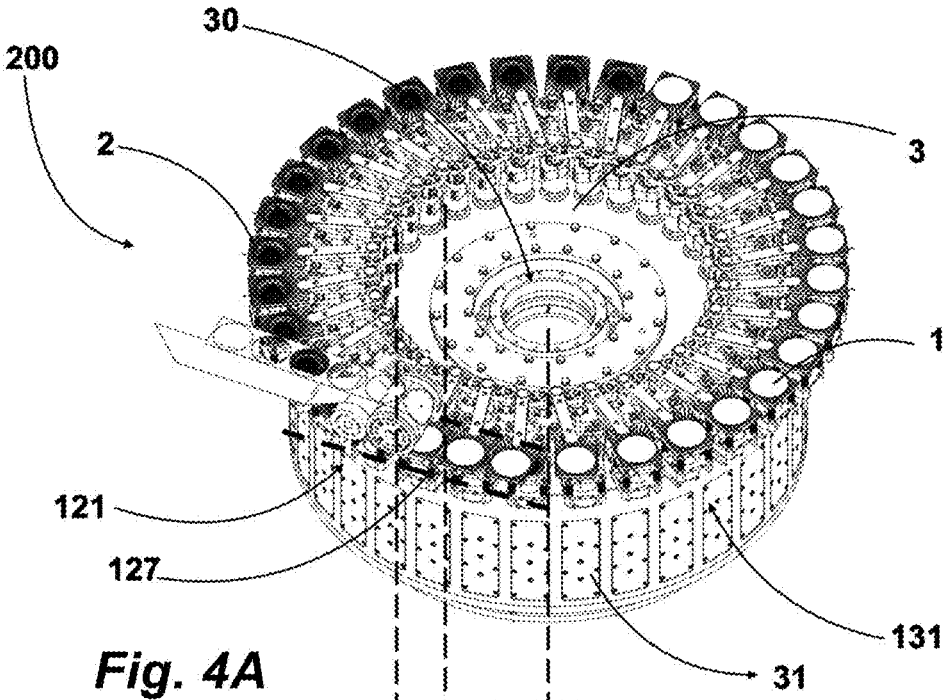
FIGS. 4A and 4B show respective perspective views of another detail of the transfer device in FIG. 2, offering a comparison between two different operating situations.
Figure 4B:
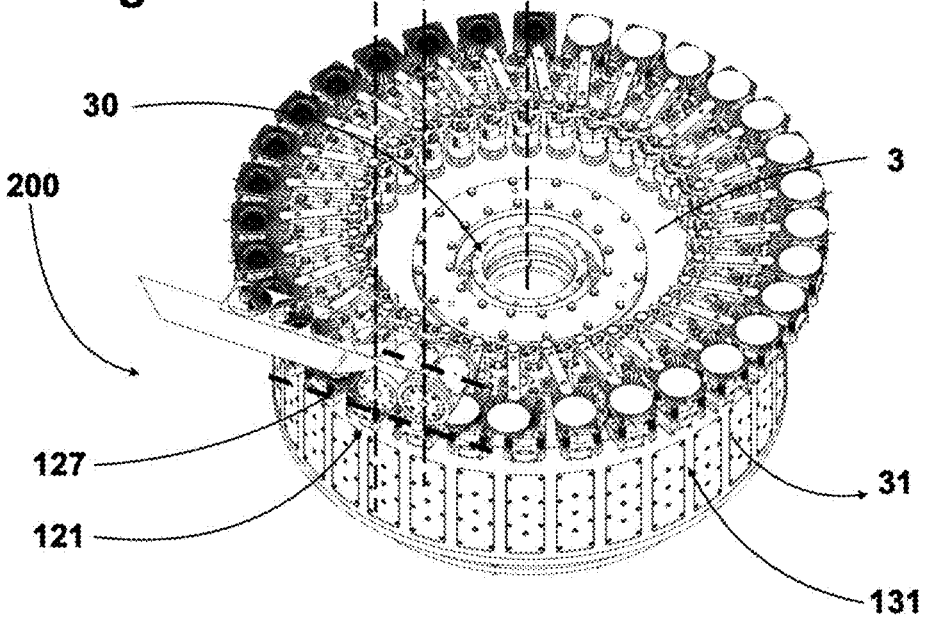

Furthermore, a process for providing a format change in the transfer device includes a step of selecting discrete elements 1 for one or more formats, for example 2 as described with reference to FIGS. 4A and 4B, which show second drum rollers 124 of different diameters, one more forward and the other more rearward on the release segment 127.

These different diameters of the discrete elements 1, which are generally formed, result, for each format, in a respective one release spot of the discrete element 1, and a different spacing between discrete elements 1 which results in a different diameter of the second roller-like drum 124 and a different release speed of the discrete element 1.

It is understood that, to meet contingent requirements, the minimum spacing condition on the flat strip 123 may be exceeded, so that it may be necessary to prepare the transfer device for different format conditions, involving a selection step as outlined above.

It is also understood that the present transfer device 200 may be prepared for any number of discrete element formats, from one onwards, preferably two or more.

The transport device 131 has a plurality of receiving elements 2, each apt to receive a respective discrete element 1, which are movable by moving along a transport path at a predetermined speed and continuously.

The transport device is of the carousel type with a rotary drum 3 on which the receiving elements 2 are mounted.

The rotary drum 3 comprises a cylindrical body 31 rotating about a vertical axis, defined by a hub 30, and supported by a base 32 fixed and integral with a fixed frame not represented but well understood, and thus the receiving elements 2 move in a substantially horizontal plane on which said transport path lies.

Each receiving element 2 comprises a horizontal flat surface, on which said discrete elements 1 are released, which has a surface knurling 4 to realise the friction between discrete element 1 and receiving surface which, in subsequent shaping operations, concur to form a surface pleat of the filter.

In order to retain the discrete element 1 in a fixed reference position, the receiving element 2 may comprise a vacuum forming suction system between the receiving surface and the discrete element 1.

In this embodiment example, the transport path of the receiving elements 2 develops along a closed line, in particular a circular line, in which said receiving elements 2 circulate on the transport path, and in particular the transport path is substantially circular because it is 2 formed on the periphery of said circular rotary drum 3.

In view of the foregoing, said discrete element release path 1, and in particular release segment 127, intersects said receiving element transport path 2 at a receiving segment thereof, located in proximity to release device 121.

In the present embodiment example, the receiving segment has a linear development, in particular it is a straight segment that connects with the circular closed path followed by the receiving elements 2 when they are distant from the release device 121.

The transport device 131 comprises an equipment for timing the position of the receiving elements 2 which acts on them by moving them with respect to the transport path determined by the mere rotation of the rotary drum 30, in order to realise said straight receiving segment.

For this purpose, the timing equipment moves the receiving elements 2 so that the position thereof, at least in said receiving segment, corresponds exactly to the release spot(s) of the discrete elements constituting the respective release segment 127.

In the present embodiment example, which describes a possible preferred but not limiting solution, the timing equipment aligns the receiving elements with each other at said receiving segment (FIG. 6).

In this way, the linear release segment 127 overlaps with the transport path at said receiving segment, which is also linear, overlapping it along its entire length.

In general terms, the timing equipment acts on the receiving elements 2 by moving them with respect to the transport device 131, so that their motion, in the receiving segment, is synchronised with that of the discrete elements 1 in the release segment 127.

Note that at the start of the straight segment the receiving elements have a lower transit speed than they do near the exit of the receiving segment.

This difference in speed is imposed so that the transit speed may be conforming, i.e. be substantially equal in direction and intensity, to the release speed at the various release spots, which, as seen above, may depend directly on the spacing of the discrete elements 1, i.e. their diameter or format.

In the segments with different speeds, the distance between two adjacent receiving elements will also vary: shorter at lower speeds and longer at higher speeds.

A change in the transit speed, which corresponds to a similar difference in the release speed, accompanied by a similar change in the distance between adjacent receiving elements 2 is implied in maintaining the same passage frequency of the discrete elements 1, which is a condition that is desirable to achieve in a transfer device with a change of format of the discrete elements 1.

Thus, the receiving elements 2 are movable and the timing equipment comprises, for each receiving element 2, a rotatable articulation which is driven by the transport device 131 because it is integral with the rotary drum 3.

Said rotatable articulation comprises a system of levers articulated among themselves, capable of moving the receiving element with three degrees of freedom, i.e., capable of raising and lowering it with respect to the rotary drum 3, of rotating it on itself around an axis perpendicular thereto, and of roto-translating it thanks to a main lever 5 movable around a fulcrum 6 which is connected to an equipment of rotation of the lever 5 around its fulcrum 6.

This rotation mechanism can be realised in many ways, for example by an electric motor adjusting the position of the lever 5 by making a so-called electronic cam.

Otherwise, it is possible to realise such an equipment with only mechanical parts. For example, the rotational mechanism comprises a cam transferor which is connected to said lever 5 at its fulcrum 6.

The aforesaid cam transferor is therefore dragged by the rotary drum but interacts with a cam, integral with the base 31, moving on it.

The shape of the cam is such as to determine a rotation of the lever 5 such that a correspondence is determined between the receiving elements 2, in said receiving segment, and said release segment 127 of the release device 121.

In general, therefore, the movement of the aforesaid rotatable articulation is controlled by a cam, which may be of a mechanical type, integral to the fixed frame, or of an electronic type; in the mechanical case, it may also be achieved by a set of cams. In this way, the motion of the rotatable articulation is synchronised with that of the discrete elements in the release segment.

Again with reference to FIGS. 4A and 4B, it is observed that, the timing equipment provides for modifying the transport path of the receiving elements 2 at the release segment 127 of the discrete elements 1, synchronising their motion so that the release spot of the discrete element 1 falls in the receiving segment in which the receiving elements 2 are aligned with each other, i.e. correspond with the release segment 127, although the receiving elements 2 continue to rotate continuously, dragged by the rotary drum 3.

Figure 5:
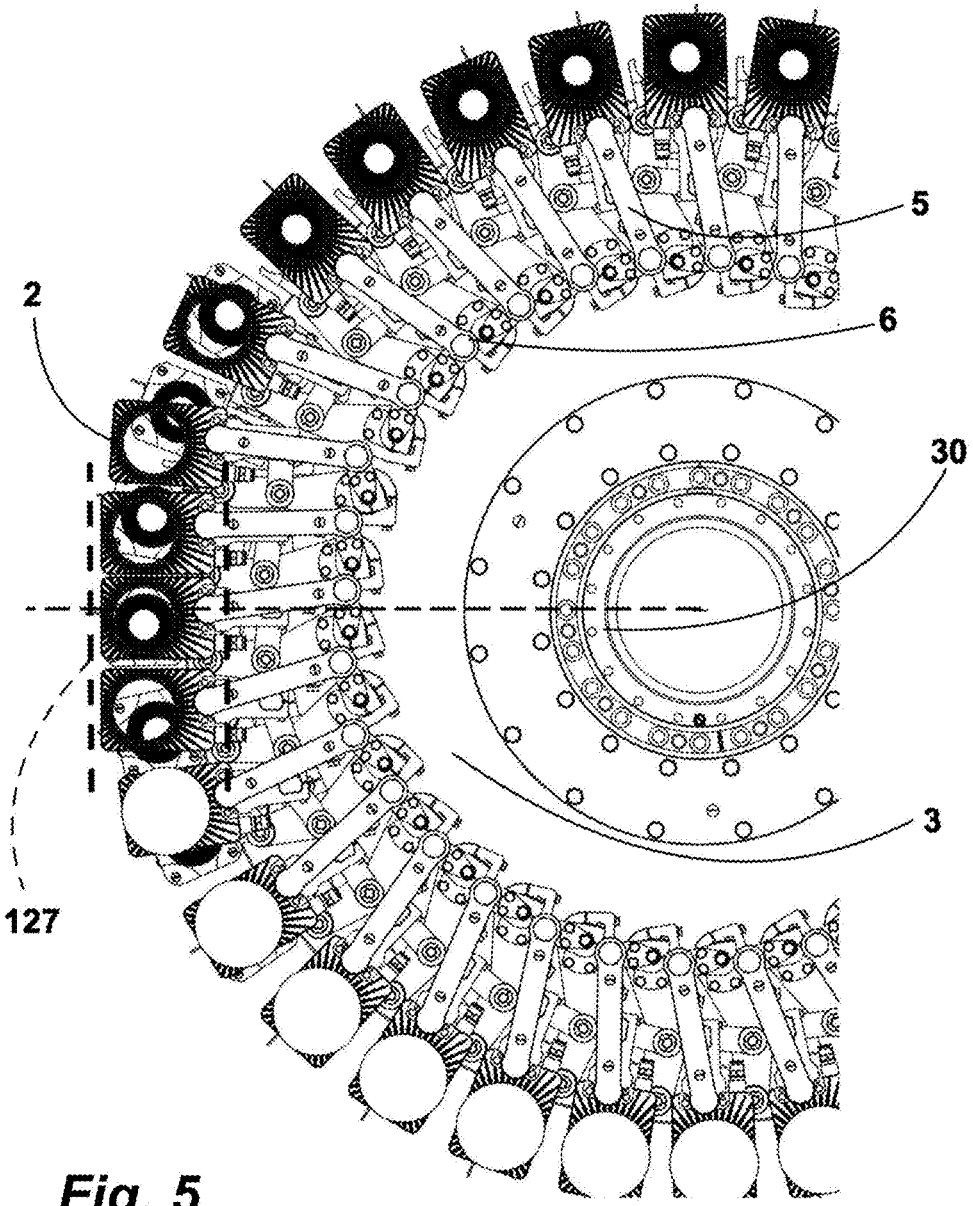
FIG. 5 shows an enlarged plan view of a further detail of the transfer device in FIG. 2.

The displacement of receiving elements 2 is illustrated in more detail in FIG. 5.

In particular, the law of motion governing the movement of the receiving elements 2 in the receiving segment is altered by the timing equipment in such a way that the receiving segment comprises one or more portions of the transport path in which the receiving elements 2 translate, and in which their translation speed, relative to their transit speed in the remaining portions of the transport path, is substantially constant.

Thus, the timing equipment realizes a transfer step in which the receiving elements 2 are moved on the transport device 131 so that their position in said receiving segment corresponds to that of the discrete elements 1 in the release segment 127, i.e. in at least a portion of the receiving segment and the transport path that corresponds to a release spot of a discrete element with a predetermined format.

In those portions, the timing equipment of the transport device 131 acts to vary the transport path and the transit speed of the receiving elements 2 at said release segment 127.

Therefore, in order to carry out a format change in the transfer device 200, a phase is provided in which one or more portions of the transport path positioned at said release segment 127 and with constant translation speeds are prepared by means of the timing equipment, in which the position of said portions of the path and the respective translation speeds conform to the discrete elements 1 selected in the format change.

In addition, to adapt the transfer device 200 to this format change, as mentioned above, a phase is envisaged in which a cam profile, mechanical or electronic, is determined to be able to manage the format change of discrete elements 1 with different formats, in particular diameters.

More specifically, the receiving segment may comprise two or more such portions, two in the present example, where the aforesaid translation speed is substantially constant, but differs from portion to portion, again by appropriately determining the cam profile.

This correspondence ensures that the transfer of discrete elements 1 is successful whatever the release spot in the release segment.

From the point of view of the spacing between discrete elements 1, it is possible to identify basically two cases that stand out among others in terms of relevance.

In the first case, provision is made in the process of setting up a format change in the transfer device for the possibility of the device transferring discrete articles 1 of different formats, e.g. in terms of size, appearance, colour, material and so on.

This change could be made without changing the spacing of the discrete elements 1. In the present example, this is done by replacing the roller-like drum 124 in the release device 121 which is responsible for cutting the discrete elements 1. In this example, it is the diameter of the roller-like drums 124 that can be mounted in the release device that remains constant, and it determines the release spots that will be the same for the different formats, and therefore fall in the same receiving segment.

Otherwise, the replacement of the roller-like drums 124 can be carried out by varying the spacing, for example to obtain maximum utilisation of the strip being cut, and then varying the diameter of the roller-like drums being replaced to carry out the format change.

In this case, the variation in diameter results in a variation in spacing between discrete elements, and thus leads to different release spots falling on different portions of the receiving segment.

In both cases, it is possible to prepare the transfer device for the format change, and thus to carry out the format change without having to intervene on the transfer device again.

It should be noted that in the case of discrete elements obtained from a strip by cutting from a roller-like drum with cutting elements, the format change of the discrete elements can actually be achieved with roller-like drums 124 in the release device 121 of the same diameter.

Thus in the aforesaid process, the steps of feeding discrete elements to the inlet integrate a step in which the discrete elements are formed in the release device.

In other words, the step of obtaining, by cutting a ribbon in this example, the discrete elements to feed them into the transfer device is integrated into the release device.

It is understood that what is described above with respect to disc-shaped discrete elements can be extended to discrete elements of different shapes.

The above-described transfer device, transfer process, packaging apparatus and format change steps may be subject to numerous further modifications and variations by a skilled person in the art in order to meet additional, contingent requirements, all of which are within the scope of protection of the present invention as defined by the appended claims.

The invention claimed is:

1. A transfer device for discrete elements, the transfer device having an inlet, wherein discrete elements are fed to the inlet in a row with a predetermined spacing, the transfer device comprising:

a carousel-like transport device comprising receiving members, wherein the receiving members are configured to move position within the carousel-like transport device and to move along a closed line transport path, the closed line transport path comprising a receiving segment defined where each receiving member receives a respective discrete element; and a release device, wherein the discrete elements are configured to be transported along a release path with a linear development, the release device comprising a release segment and intersecting said closed line transport path at said receiving segment;

wherein, in said receiving segment, movement of the receiving members within the carousel-like transport device is synchronized with movement of the discrete elements in the release segment of the releasing device, allowing the discrete elements to be released to a respective receiving member.

2. The transfer device according to claim 1, wherein said receiving segment comprises one or more portions configured to be travelled by the receiving members at respective substantially constant translation speeds.

3. The transfer device according to claim 2, wherein said receiving segment comprises two or more portions configured to be travelled by the receiving members at different substantially constant translation speeds.

4. The transfer device according to claim 1, wherein the carousel-like transport device comprises a rotary drum, the receiving members being mounted on a periphery of the rotary drum, the closed line transport path being substantially circular.

5. The transfer device according to claim 1, wherein, at the receiving segment, the receiving members are aligned to each other.

6. The transfer device according to claim 1, wherein the carousel-like transport device comprises, for each receiving member, a rotatable articulation actuated by the carousel-like transport device to synchronize a movement of the respective receiving member with the movement of the discrete elements in the release segment.

7. The transfer device according to claim 6, further comprising a cam configured to drive said rotatable articulation.

8. The transfer device according to claim 1, wherein said release path with a linear development is defined by a planar strip, from which the discrete elements are cut with said predetermined spacing.

9. The transfer device according to claim 8, wherein:

said receiving segment comprises one or more portions configured to be travelled by the receiving members at respective substantially constant translation speeds, and said planar strip, at said release segment, is wound on a roller-like drum configured to rotate with a peripheral speed corresponding to a release speed of the discrete elements, the peripheral speed being equal to the translation speed of the receiving members.

10. The transfer device according to claim 9, wherein the release device comprises a set of roller-like drums with different diameters for discrete elements having a different format.

11. The transfer device according to claim 1, wherein each receiving member comprises a horizontal planar surface, on which the discrete elements are released.

12. A packaging apparatus comprising the transfer device according to claim 1.

13. A format changing process in a transfer device for discrete elements in accordance to different formats of the discrete elements, said discrete elements being fed in a row to an inlet of the transfer device with a predetermined spacing, the transfer device comprising:

a carousel-like transport device, wherein receiving members, each configured to receive a respective discrete element, move at a transit speed along a closed line transport path; and a release device, on which the discrete elements are transported along a release path with a linear development, the release path intersecting said closed line transport path and having a release segment comprising release spots of discrete elements in accordance with different formats of the discrete elements;

wherein, in said receiving segment, the closed line transport path and the transit speed of the receiving members are changed at said release segment of the release device, the format changing process comprising:

selecting discrete elements for one or more formats, determining a respective release spot, a spacing and/or a release speed; and providing, in the closed line transport path, one or more transport path portions, placed at said release segment, wherein position of the one or more transport path portions and respective translation speeds of the receiving members are conformed to the release spot and the release speed of selected discrete elements.

14. The format changing process according to claim 13, wherein, in the one or more transport path portions, the respective translation speeds of the receiving members are constant.

15. The format changing process according to claim 14, wherein the one or more transport path portions are at least two transport path portions, each corresponding to discrete elements fed with different spacings.

16. The format changing process according to claim 13, wherein the transfer device comprises, for each receiving member, a rotatable articulation driven by a cam, the rotatable articulation configured to be actuated by the transport device and connected to a respective receiving member, the process further comprising:

determining a profile of the cam.

17. A format changing process in a transfer device for discrete elements according to different formats of the discrete elements, fed in a row with a predetermined spacing, the transfer device comprising:

a transport device, wherein receiving members, each configured to receive a respective discrete element, move along a closed line transport path where a linear receiving segment of the discrete elements is defined; and a release device, on which said discrete elements are transported along a release path with a linear development, the release path being superimposed to said linear receiving segment, the format changing process comprising:

feeding, to an inlet, discrete elements having a first format in a row with a respective predetermined spacing; and feeding, to the inlet, discrete elements having at least one other format in a row with a respective predetermined spacing, wherein a respective release spot of a discrete element is determined by said spacing on a respective receiving portion of the receiving segment.

18. The format changing process according to claim 17, wherein, when the spacing of the at least one other format is identical to the spacing of the first format, the release spot of the discrete elements of the first format and of the at least one other format falls into a same receiving portion.

19. The format changing process according to claim 17, wherein, when the spacing of the at least one other format is different from the spacing of the first format, the release spot of the discrete elements of the first format and of the at least one other format falls into different receiving portions.

20. The format changing process according to claim 17, wherein feedings of the discrete elements comprise forming the discrete elements in the release device.

* * * * *